United States Patent [19]

Marozzi

[11] Patent Number: 4,566,387

[45] Date of Patent: Jan. 28, 1986

[54] ARTICLE IMPRINTER AND CARTRIDGE INKER

[76] Inventor: Alfred A. Marozzi, 3 Cheryl Pl., Pine Brook, N.J. 07058

[21] Appl. No.: 592,374

[22] Filed: Mar. 22, 1984

[51] Int. Cl.[4] ..... B41K 1/42; B41F 31/24

[52] U.S. Cl. ..... 101/330; 74/435

[58] Field of Search ..... 101/330, 331, 329, 328, 101/333, 35, 36, 37, 40, 232, 348, 349, 350, 351, 352, 363, 364, 335; 74/435

[56] References Cited

U.S. PATENT DOCUMENTS

| | | | |
|---|---|---|---|
| 160,947 | 3/1875 | Palmer et al. | 101/350 X |
| 3,101,586 | 8/1963 | Polonsky et al. | 74/435 X |
| 3,179,043 | 4/1965 | Mellison | 101/35 |
| 3,208,375 | 9/1965 | Worth | 101/35 |
| 3,220,341 | 11/1965 | Price, Jr. | 101/35 |
| 3,457,854 | 7/1969 | Marozzi | 101/330 X |
| 3,491,683 | 1/1970 | Farrow | 101/333 X |
| 3,624,730 | 11/1971 | Gottscho | 101/35 |
| 3,662,682 | 5/1972 | Marozzi | 101/350 X |
| 3,678,848 | 7/1972 | Roser et al. | 101/333 X |
| 3,804,016 | 4/1974 | Marozzi et al. | 101/333 |
| 4,023,490 | 5/1977 | Marozzi | 101/328 X |
| 4,145,967 | 3/1979 | Marozzi | 101/328 X |

*Primary Examiner*—Clifford D. Crowder

*Attorney, Agent, or Firm*—Harvey B. Jacobson

[57] ABSTRACT

An imprinter having a continuously rotated printing wheel, is inked through a transfer roller drivingly connected by intermittent gearing to the printing wheel, the roller being in contact with a Teflon surface of an arcuate ink pad projecting from an ink storing cartridge within an inking chamber housing an excess ink wiper.

9 Claims, 13 Drawing Figures

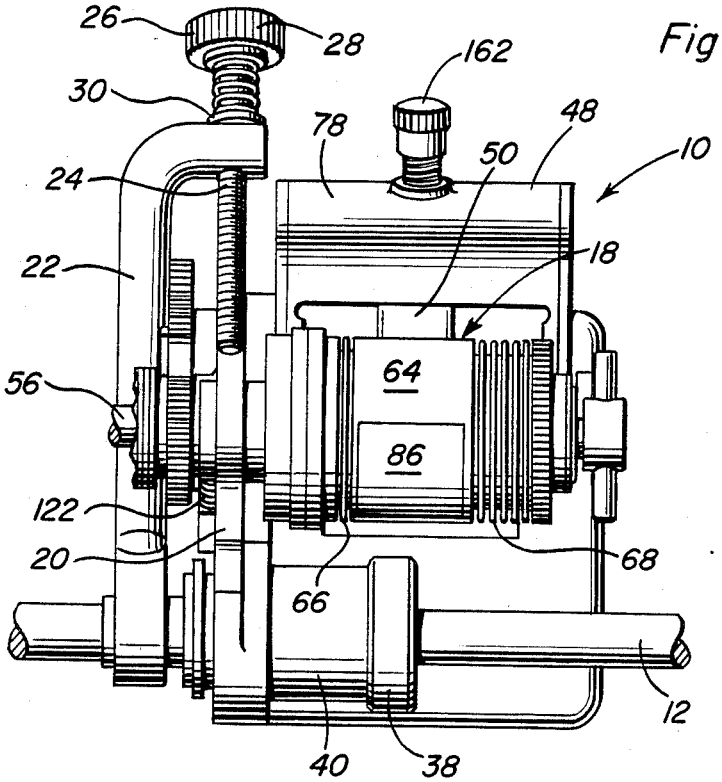
Fig. 3
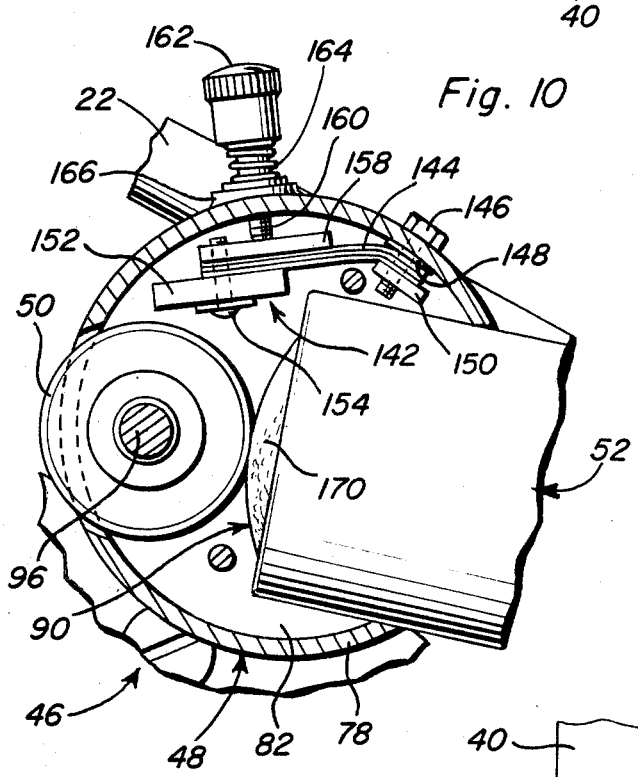
Fig. 10
Fig. 12
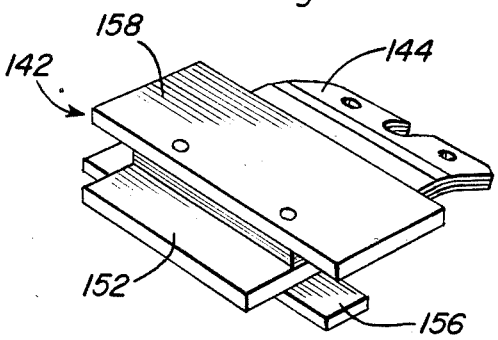
Fig. 11
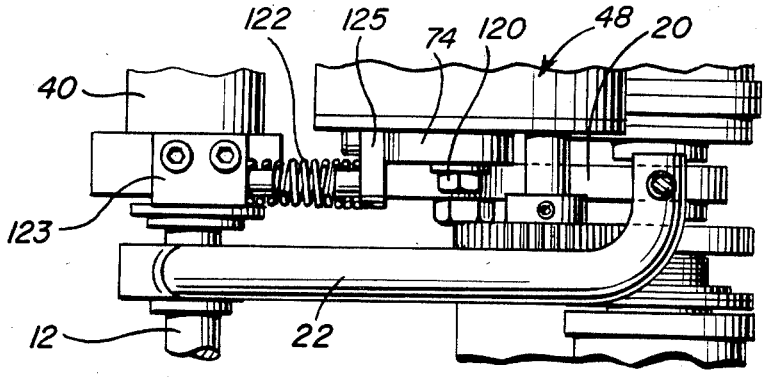

ARTICLE IMPRINTER AND CARTRIDGE INKER

BACKGROUND OF THE INVENTION

This invention relates to the imprinting of moving surfaces by a printer having a rotatable printing wheel to which ink is transferred from an ink storage through a rotating ink transfer roller.

Printers of the foregoing type are already well known as disclosed in prior U.S. Pat. Nos. 3,361,062, 3,457,854 and 3,662,682 owned by the assignee of the present application. U.S. Pat. No. 3,361,062 to Proctor features means for angularly adjusting and orientating the transfer roller relative to the print wheelfor proper transfer of ink. U.S. Pat. No. 3,457,854 to Marozzi is addressed to the problem of regulating the quantity of ink being transferred by adjusting an excess ink wiper arrangement associated with the transfer roller. The storage of a fast drying ink within a replaceable ink storing cartridge, is featured in U.S. Pat. No. 3,662,682 to Marozzi. Several problems are associated with the foregoing type of printer, including rapid wear of parts causing vibration, deterioration of performance, and a rapid depletion of ink.

It is therefore an important object of the present invention to provide an improved printer for imprinting moving surfaces of articles, packaging film or the like at spaced locations thereon with a relatively fast drying ink for longer, uninterrupted operational periods with acceptable printing quality.

SUMMARY OF THE INVENTION

In accordance with the present invention, print wheel continuously rotated during operational intervals and an ink transfer roller intermittently rotated during such intervals in the foregoing type of printer are rotated at the same linear surface speed through intermittent gearing having gear teeth modified to reduce the adverse affect of impact, accompanying the discontinuous or interrupted rotation of the transfer roller each revolution of the print wheel, by virtue of which wear is reduced on both the transfer roller and the excess ink wiper blade. The ink transfer roller is carried by an inking cylinder adjustably positioned on a support arm by an eccentric adjustment element to establish an optimum meshing relationship for the intermittent gearing. The inking cylinder also carries the replaceable ink storing cartridge from which an arcuate ink pad projects into wiping contact with the transfer roller. The ink pad has a Teflon cover surface. A single, flat wiper blade is adjustably positioned relative to the transfer roller to remove excess ink therefrom.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a front view of the imprinter shown in FIGS. 1 and 2.

FIGS. 9 and 10 are partial sectional views taken substantially through a plane indicated by section lines 9—9 and 10—10 in FIG. 5.

FIG. 11 is a partial sectional view taken substantially through a plane indicated by section line 11—11 in FIG. 2.

FIG. 12 is a perspective view of the wiper disassembled from the inking device as shown in FIG. 10.

DETAILED DESCRIPTION OF PREFERRED EMBODIMENT

Figure 1:
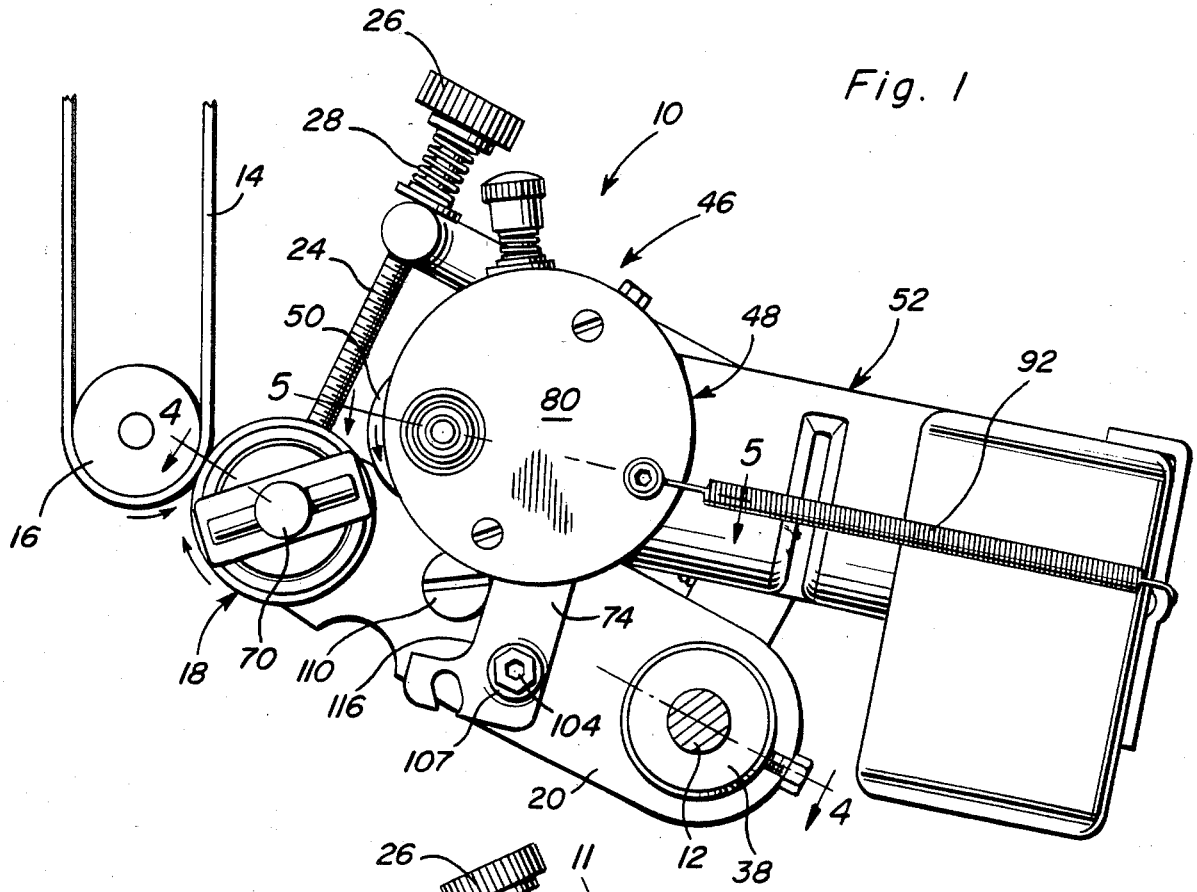
FIG. 1 is a side view of an imprinter assembly in accordance with one embodiment of the invention.
Figure 2:
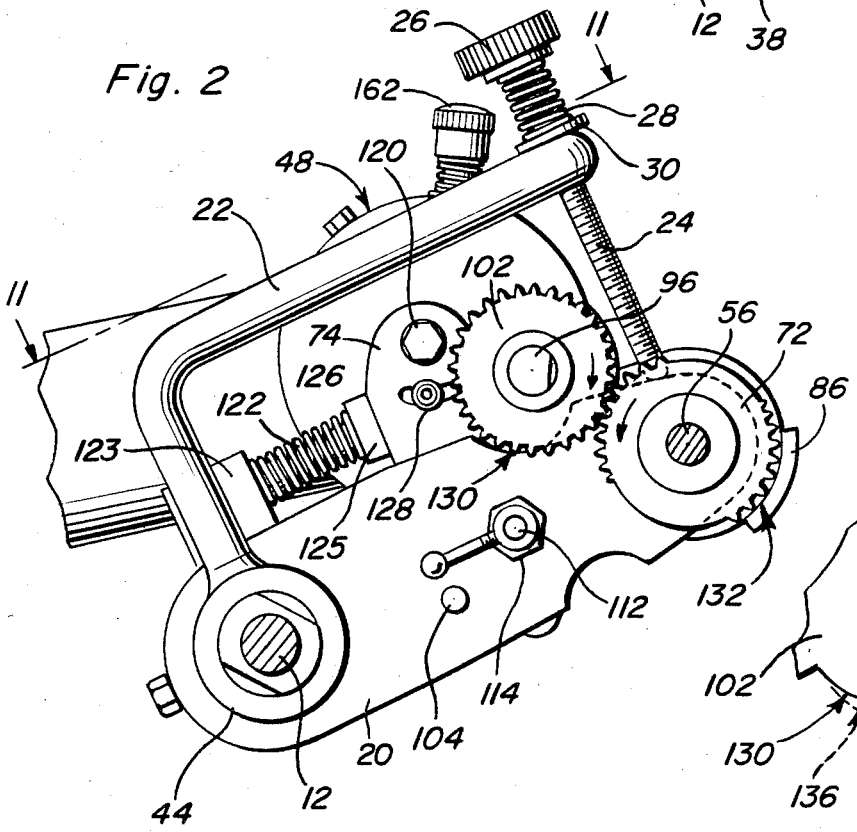
FIG. 2 is a partial side view of the imprinter as seen from a side opposite that of FIG. 1.
Figure 4:
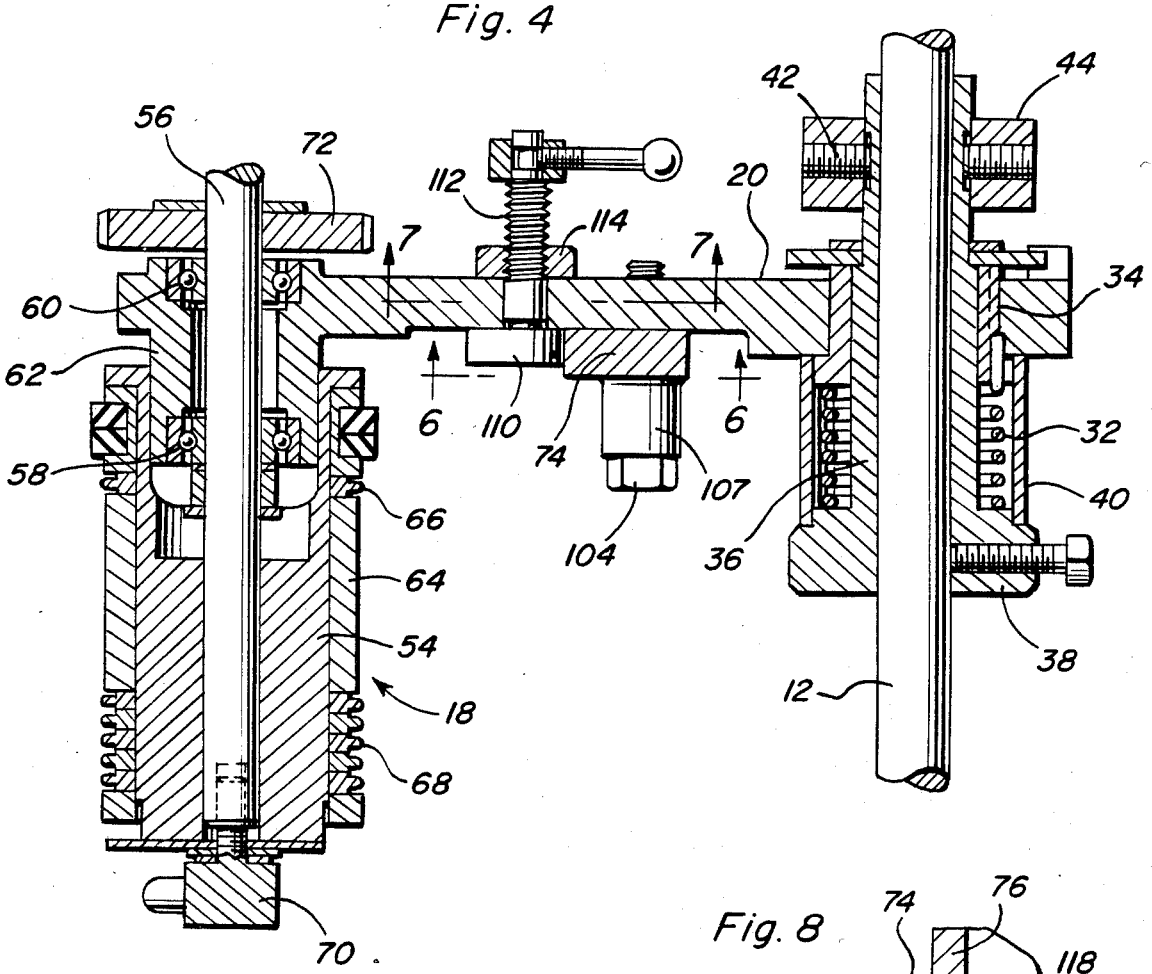
FIG. 4 is an enlarged sectional view taken substantially through a plane indicated by section line 4—4 in FIG. 1.

Referring now to the drawings in detail, FIGS. 1, 2 and 3 show an imprinter constructed and installed in accordance with the present invention, and referred to generally by reference numeral 10. The imprinter 10 is supported on a suitable frame by means of a fixed support shaft 12 in operative relation to the surfaces being imprinted, such as a continuously moving web or strip 14 entrained about a backing roller 16. Other moving surfaces advanced by different drive mechanism may also be imprinted. The general arrangement of the imprinter 10 is disclosed in my prior U.S. Pat. No. 3,662,682, aforementioned, and includes a printing wheel assembly 18 rotatably mounted at one end of mounting lever arm 20 pivotally supported at its opposite end on the support shaft 12. An angulated bracket 22 is fixed to the support shaft 12 and threadedly mounts an adjustment screw 24 engaged with the end of the support arm 20 adjacent the printing wheel assembly 18 to hold it in an angularly adjusted position for imprinting the moving surface strip 14. The upper end of the adjustment screw 24 is therefore provided with an adjustment knob 26 abutting one end of a coil spring 28 seated on a washer 30 abutting the bracket 22. The screw 24 is accordingly locked in adjusted position and the support arm is biased into engagement therewith by a spring 32 having one end thereof anchored to a hub 34 fixed to the support arm 20 as shown in FIG. 4. The other end of spring 32 is anchored to a sleeve 36 fixed to the support shaft and having an end collar 38 axially spaced from hub 34. A cylindrical cover 40 extends from the support arm 20 over the flange portion of the hub 34 into engagement with collar 38 to enclose the spring 32 about sleeve 36. The sleeve projects axially through the support arm 20 and is fixed by set screws 42 to the hub portion 44 of bracket 22. An inking device generally referred to by reference numeral 46 is carried by the support arm 20 intermediate its opposite ends. Associated with the inking device is a cylindrical ink transfer housing 48, as more clearly seen in FIG. 1, from which an ink transfer roller 50 projects toward the printing wheel assembly 18. Also projecting from the ink transfer housing 48 opposite the transfer roller is an ink storing cartridge 52 of a type disclosed in my prior U.S. Pat. No. 3,662,682, aforementioned.

Referring once again to FIG. 4, the printing wheel assembly 18 includes a cylindrical body 54 fixed to a continuously rotatable power shaft 56 that is journaled by spaced bearings 58 and 60 within a hub portion 62 of the support arm 20. The hub portion 62 projects axially into a bearing cavity formed within the body 54. A cylindrical print backing sleeve 64 is axially positioned on the body 54 between spacing discs 66 and 68 for alignment with the surface 14 being imprinted. As assembly locking element 70 is threadedly connected to one end of the power shaft 56 within the body 54 at an adjacent end thereof. The other end of the power shaft extends into a drive mechanism for the imprinter (not shown). A drive gear wheel 72 is secured to the power shaft on one side of the support arm 20 opposite the printing wheel assembly 18 for imparting rotation to the ink transfer roller 50 in accordance with the present invention as will be explained in detail hereinafter.

Figure 5:
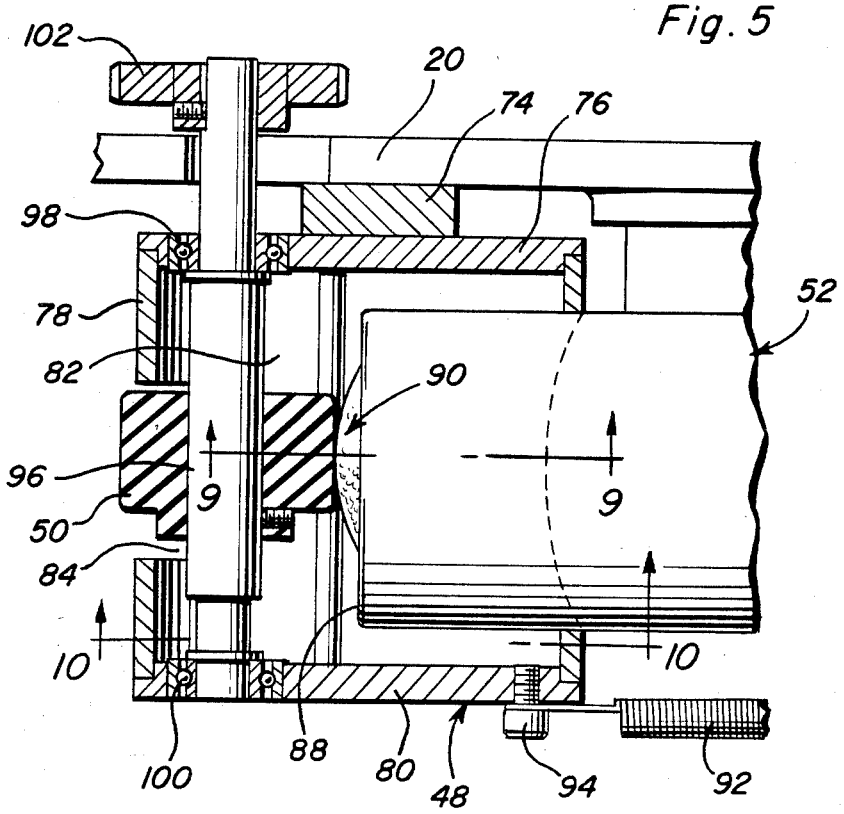
FIG. 5 is an enlarged partial sectional view taken substantially through a plane indicated by section line 5—5 in FIG. 1.
Figure 7:
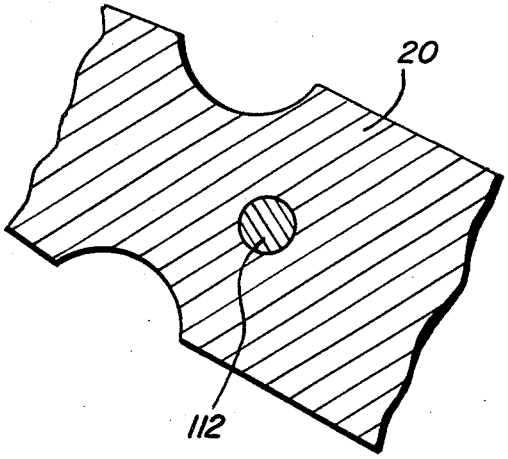

The inking device 46 as more clearly seen in FIGS. 1, 3, 5 and 10, is carried on the support arm 20 by means of an adjustable mounting element 74 connected to an adjacent circular end plate 76 of the housing 48. The cylindrical section 78 of the housing interconnects end plate 76 with the other circular end plate 80 to enclose a chamber 82, from which the transfer roller 50 projects through opening 84 in a alignment with print support plates 86 on the printing wheel assembly, as shown in FIG. 3. The ink storing cartridge 52 is inserted into or withdrawn from chamber 82 and has an inner end 88 from which an arcuate ink pad 90 projects, as shown in FIG. 5. When inserted into and installed within housing 48, the cartridge 52 is biased toward the transfer roller by a spring 92 connected at opposite ends to the outer end of the cartridge and to an anchor screw 94 secured to the end plate 80 of the housing 48. Wiping contact is thereby maintained between the ink pad 90 and the transfer roller 50 which is fixed to a roller shaft 96 journaled by bearings 98 and 100 in the end plates 76 and 80 as shown in FIG. 5. The roller shaft 96 extends axially beyond the end plate 76 and has a gear wheel 102 secured thereto in meshing relationship to the gear wheel 72 as more clearly seen in FIG. 2.

Figure 6:
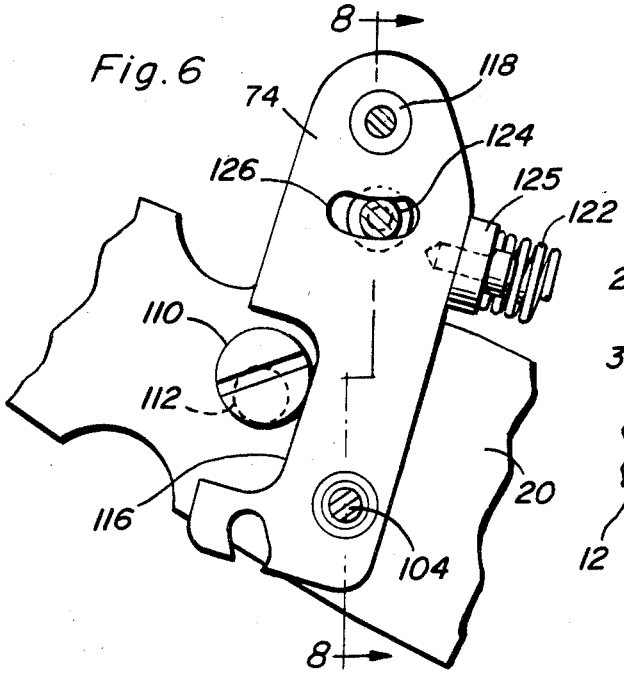
FIGS. 6 and 7 are enlarged partial sectional views taken substantially through planes indicated by section lines 6—6 and 7—7 in FIG. 4.
Figure 8:
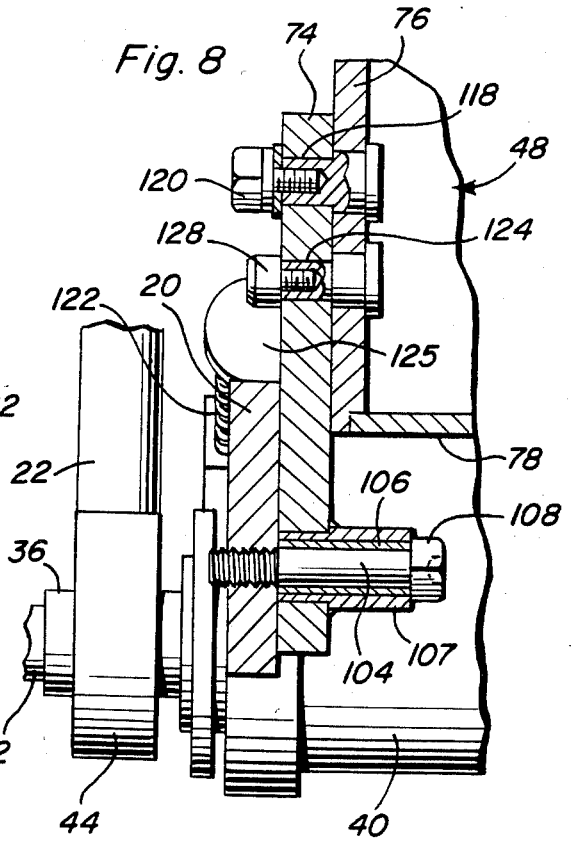
FIG. 8 is a partial sectional view taken substantially through a plane indicated by section line 8—8 in FIG. 6.

In order to establish the proper meshing relationship between gear wheels 72 and 102, the housing 48 of the inking device 46 is adjustably positioned on the support arm 20 by means of the mounting element 74 aforementioned. As more clearly seen in FIGS. 4, 6 and 8, the mounting element 74 is pivotally connected to the support arm by a shouldered pivot bolt 104 threadedly received in the support arm 20 and journaled within a bushing 106 press-fitted into a plug 107 welded to and projecting from the mounting element 74. The pivot bolt 104 is threadedly connected to the arm 20 with its head 108 abutting the end of bushing 107. The angular position of the mounting element relative to the support arm is adjusted by means of a slotted circular head 110 eccentrically connected to a threaded shank 112 extending through the support arm 20. A nut 114 locks the shank 112 in the angularly adjusted position with the head 110 engaging the mounting element 74 within a recess 116. The mounting element is connected adjacent its upper end to the end plate 76 of the housing 48 by means of a headed pivot member 118, having a threaded bore receiving a screw fastener 120. A compression spring 122 yieldably holds the mounting element in its adjusted position as more clearly seen in FIGS. 2 and 11. Opposite ends of spring 122 react against spring blocks 123 and 125 respectively secured to one end of support arm 20 and the mounting element 74. Accordingly, a spring bias is exerted on the mounting element 74 to hold it in contact with eccentric head 110 during adjustment. Further adjustment is effected by angular positioning of the housing 48 about the pivotal connecting member 118 on the mounting element 74. Toward that end, a second headed shank member 124 extends from the end plate 76 of the housing 48 through an arcuate slot 126 in the mounting element, the slot 126 having a center of curvature lying on the axis of pivot members 118 as more clearly seen in FIG. 8. The member 124 is locked in an angularly adjusted position in slot 126 by the head of a clamp screw 128 threadedly received in a bore of the member 124.

Figure 13:
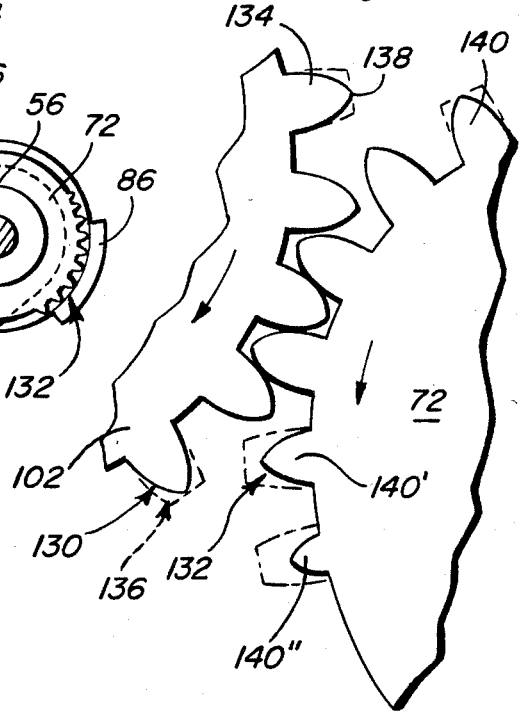
FIG. 13 is an enlarged partial side view of the intermittent gearing as shown in FIG. 2.

In the relatively adjusted position of the inking device 46 on mounting arm 20, the gear wheels 72 and 102 will be in proper meshing relationship to intermittently transmit movement from a continuously rotating power shaft 56 to the roller shaft 96. As shown in FIG. 2, the gear wheel 102 has a 360° external gear tooth rim 130 arranged to mesh with angularly spaced gear toothed rim segments 132 of the gear wheel 72. Thus, the ink transfer roller will not be rotated while the type mounting plate 86 on the printing wheel assembly is out of contact with the surface being imprinted. As shown in FIG. 13, the gear teeth 134 of gear wheel 102 are based on involute profiles 136, shown by dotted lines, modified by shaving of the opposite leading and trailing faces of the teeth so as to converge to a relatively sharp addendum edge 138. Similar modification of the involute profiles of the gear teeth 140 is effected with respect to the tooth segments 132 of the gear wheel 72. Further, two of the teeth 140′ and 140Δ of each gear segment 132 are progressively decreased in addendum height in a leading direction as shown in FIG. 13. As a result of the foregoing gear tooth profile modifications, a smooth transfer of motion of the ink transfer roller occurs for more efficient transfer of ink from the cartridge 52 to the printing wheel assembly.

The efficiency of ink transfer is further enhanced and/or dependent upon the construction of ink pad 90 in chamber 82 of the inking device and the use of a single ink wiping unit generally referred to by reference numeral 142 as shown in FIGS. 10 and 12. The wipe unit 142 includes a leaf spring element 144 anchored cantilever fashion to the cylindrical housing section 78 by screw fastener 146 between a washer 148 and an underlying clamp plate 150 through which the screw 146 threadedly extends. Secured to the free end of the leaf spring 144 is a rigid wiper blade 152 which underlies the leaf spring and projects forwardly therefrom in almost tangential relation to the transfer roller 50 as shown in FIG. 10. The wiper blade is secured to the leaf spring by a screw fastener 154 extending through an underlying clamp plate 156 and a bearing plate 158 on top of the leaf spring. The bearing plate is engaged by the inner end of an adjustment screw 160 connected at its other external end to an adjustment knob 162. A coil spring 164 reacts between the housing section 78 and the adjustment knob 162 to exert a screw thread locking pressure for holding the adjustment screw 160 in axially adjusted position relative to the internally threaded nut formation 166 on the housing section. The leaf spring 144 is thereby held in an adjusted, deflected position for contact between the wiper blade 152 and the transfer roller with the proper wiper pressure effective to remove excess ink from the roller during rotation as well as to intermittently stop rotation imparted by the powered drive through the gearing formed by the meshing gear wheels 72 and 102.

Figure 9:
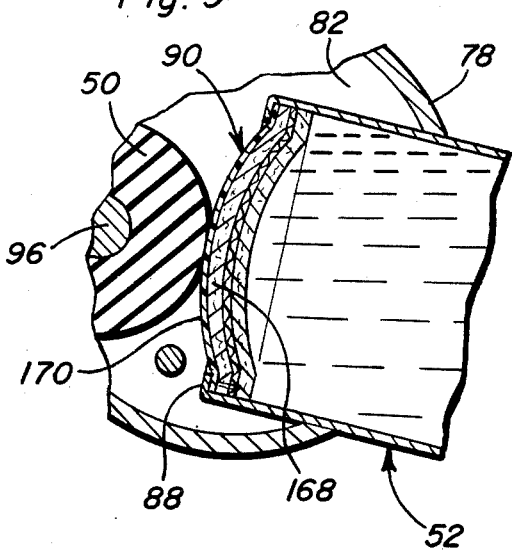

The ink pad 90 as shown in FIG. 9 is responsible for supply of a controlled amount of liquid ink from cartridge 52. The ink pad includes an arcuate body 168 made of absorbent material closing the inner end 88 of the cartridge and projecting therefrom toward the roller 50. A Teflon film 170 forms a surface layer on the pad body 168 having the appropriate porosity to control the flow of liquid ink onto the surface of the roller during intermittent rotation thereof for an ink transfer operation of unexpected optimum efficiency.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In an article imprinter including a pivotal mounting arm; a printing wheel rotatably mounted on said arm; an inking device carried by the mounting arm having an ink storing cartridge, a transfer roller mounted in operative relation to the cartridge and the printing wheel and wiper means for removing excess ink transferred from the cartridge to the transfer roller; transmitting means connected to the printing wheel for powered rotation thereof in one direction, intermittently engaged gear means including a first gear wheel connected to the transfer roller having a continuous toothed rim, and a second gear wheel connected to the printing wheel having at least one toothed rim segment of less than 360°, the improvement comprising means supporting the inking device on the mounting arm in adjustably positioned relation to the printing wheel for maintaining optimum meshing of the gear wheels of the intermittently engaged gear means, at least two of the gear teeth of the rim segment, leading in the one direction of rotation, being progressively reduced in addendum, whereby operational wear and depletion of ink stored by the inking device is minimized.

2. The improvement as defined in claim 1 wherein said ink storing cartridge includes an ink transferring end and an arcuate ink pad projecting from said end toward the transfer roller, the ink pad having an ink absorbent body and an external Teflon surface layer in contact with the transfer roller in spaced relation to said end of the cartridge.

3. The improvement as defined in claim 1 wherein the supporting means includes a lever element pivotally mounted on the mounting arm, means fixedly securing the inking device to the lever element in an adjusted position, spring means for biasing the lever element and the inking device in one direction relative to the mounting arm toward the printing wheel, and means for limiting displacement of the lever element in said one direction.

4. The improvement as defined in claim 1 wherein said ink storing cartridge includes an ink transferring end and an arcuate ink pad projecting from said end toward the transfer roller, the ink pad having an ink absorbent body and an external Teflon surface layer in contact with the transfer roller in spaced relation to said end of the cartridge.

5. The imprinter as defined in claim 4 wherein the inking device further includes a housing enclosing a chamber within which the transfer roller and the ink pad contact each other, the wiper means including a rigid element, a flexible element anchored to the housing on which the rigid element is supported, and adjustable means engageable with the flexible element for holding the rigid element in wiping contact with the transfer roller within the chamber.

6. In an article imprinter including a pivotal mounting arm; a printing wheel rotatably mounted on said arm; an inking device carried by the mounting arm having an ink storing cartridge, a transfer roller mounted in operative relation to one end of the cartridge and the printing wheel and wiper means for removing excess ink transferred from the cartridge to the transfer roller; and power transmitting means connected to the printing wheel for rotation thereof, the improvement residing in means for minimizing depletion of ink and stored in the cartridge, comprising an arcuate ink pad projecting from said one end of the cartridge toward the transfer roller, the ink pad having an absorbent body and an external Teflon surface layer in contact with the transfer roller in spaced relation to said one end of the cartridge.

7. The imprinter as defined in claim 6 wherein the inking device further includes a housing enclosing a chamber within which the transfer roller and the ink pad contact each other, the wiper means including a rigid element, a flexible element anchored to the housing on which the rigid element is supported, and adjustable means engageable with the flexible element for holding the rigid element in wiping contact with the transfer roller within the chamber.

8. In an article imprinter including a pivotal mounting arm; a printing wheel rotatably mounted on said arm; an inking device carried by the mounting arm having an ink storing cartridge, a transfer roller mounted in operative relation to the cartridge and the printing wheel and wiper means for removing excess ink transferred from the cartridge to the transfer roller; and power transmitting means connected to the printing wheel for rotation thereof in one direction, a first gear wheel connected to the transfer roller having a continuous toothed rim, a second gear wheel connected to the printing wheel having at least one toothed rim segment of less than 360°, said rim and rim segment being formed with involute gear teeth modified by convergence of opposite tooth faces to a tip edge, the improvement residing in at least two of the gear teeth of the rim segment, leading in the one direction of rotation, being progressively reduced in addendum and means holding the transfer roller adjustably positioned on the arm for non-jamming intermittent mesh of the modified involute gear teeth whereby impact on said leading gear teeth of the rim segment during risk transfer intervals is minimized.

9. The improvement as defined in claim 8 including a lever element pivotally mounted on the mounting arm, means fixedly securing the inking device to the lever element in an adjusted position, spring means for biasing the the lever element and the inking device in one direction relative to the mounting arm toward the printing wheel, and means for limiting displacement of the lever element in said one direction.

* * * * *